US008075258B2

(12) United States Patent
Horng et al.

(10) Patent No.: US 8,075,258 B2
(45) Date of Patent: Dec. 13, 2011

(54) HEAT-DISSIPATING FAN HOUSING

(75) Inventors: Alex Horng, Kaohsiung (TW); Ming-Tsung Li, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 389 days.

(21) Appl. No.: 12/430,945

(22) Filed: Apr. 28, 2009

(65) Prior Publication Data

US 2010/0272567 A1 Oct. 28, 2010

(51) Int. Cl.
*F04D 29/44* (2006.01)
*F04D 29/54* (2006.01)

(52) U.S. Cl. ..... 415/186; 415/220; 415/223; 417/361; 417/423.3; 417/423.7

(58) Field of Classification Search ..... 415/119, 415/186, 187, 188, 220, 223
See application file for complete search history.

(56) References Cited

U.S. PATENT DOCUMENTS 7,066,720 B2 6/2006 Cheng et al.
7,223,068 B2 5/2007 Horng et al.
7,234,919 B2 * 6/2007 Lee et al. ..... 415/208.2
7,275,911 B2 10/2007 Lee et al.
7,726,939 B2 * 6/2010 Lee et al. ..... 415/211.2
2006/0045736 A1 * 3/2006 Lee et al. ..... 415/220
2007/0253814 A1 * 11/2007 Lee et al. ..... 415/220
2010/0243218 A1 * 9/2010 Horng et al. ..... 165/121

FOREIGN PATENT DOCUMENTS

TW I276743 3/2007

* cited by examiner

*Primary Examiner* — David Nhu
(74) *Attorney, Agent, or Firm* — Alan Kamrath; Kamrath & Associates PA

(57) ABSTRACT

A heat-dissipating fan housing includes a casing having a compartment with an impeller section, a stationary blade section, and an airflow concentration section arranged from an air inlet toward an air outlet spaced from the air inlet in an axial direction. A mounting portion is received in the compartment, and an impeller is rotatably coupled to the mounting portion for driving airflows. Stationary blades are interconnected between the casing and the mounting portion and are received in the stationary blade section. Each stationary blade includes a first edge facing the air inlet and a second edge facing the air outlet. The airflow concentration section is between the second edge of each stationary blade and the air outlet in the axial direction. The airflow concentration section concentrates the airflows after passing through the stationary blades. The noise is reduced, the wind pressure is increased, and less electricity is consumed.

8 Claims, 6 Drawing Sheets

HEAT-DISSIPATING FAN HOUSING

BACKGROUND OF THE INVENTION

1. Field of the Invention

The present invention relates to a heat-dissipating fan housing and, more particularly, to a heat-dissipating fan housing with stationary blades.

2. Description of the Related Art

FIGS. 1 and 2 show a typical conventional heat-dissipating fan housing 80 including a casing 81 with a mounting portion 82 at an inner side thereof. An impeller 83 is coupled to the mounting portion 82 and can be driven by a drive 85 to rotate. The mounting portion 82 includes a plurality of stationary blades 84 forming a guiding device. Each stationary blade 84 extends in a radial direction surrounding the mounting portion 82 to guide airflows created by rotating the impeller 83, increasing the wind pressure of the airflows. The casing 81 further includes an air inlet 811 and an air outlet 812. Each stationary blade 84 is at an acute angle with a longitudinal axis of the casing 81 and includes a bottom edge 841 contiguous to and flush with the air outlet 812. However, there is no structure for concentrating the airflows leaving the air outlet 812 such that the airflows leave the air outlet 812 in different directions due to the acute angle between each stationary blade 84 and the longitudinal axis of the casing 81, resulting in noise and failing to effectively increase the wind pressure. Although, the bottom edge 841 of each stationary blade 84 may not be flush with the air outlet 812 due to uncertainties during manufacturing (such as tolerances of molds or manufacturing errors in quality control), the spacing between the bottom edge 841 of each stationary blade 84 and the air outlet 812 is still insufficient to guide and concentrate the airflows.

FIG. 3 shows another conventional heat-dissipating fan housing 90 including a casing 91 with an air inlet 911 and an air outlet 912. A plurality of stationary blades 92 is formed in an inner side of the casing 91 at regular intervals. A wing-shaped guiding member 93 is formed on an inner edge of the casing 91 and between two adjacent stationary blades 92. An impeller 94 is rotatably coupled to the casing 91. Each of the stationary blades 92 and the wing-shaped guiding members 93 includes a bottom edge 921, 931 adjacent to the air outlet 912. Operational noise is reduced by reducing turbulence passing through the stationary blades 92 through provision of the wing-shaped guiding members 93 and the stationary blades 92. An example of such a heat-dissipating fan is disclosed in Taiwan Invention Patent Publication No. 1276743 entitled "Fan Housing and Fans with Stationary Blades". However, the wing-shaped guiding members 93 increase the overall manufacturing costs. Furthermore, although the bottom edge 931 of each wing-shaped guiding member 93 is not flush with the air outlet 912, the bottom edge 921 of each stationary blade 92 is flush with the air outlet 912 such that there is no structure in the inner side of the casing 91 at the area adjacent to the air outlet 912 for concentrating the airflows leaving the air outlet 912. Thus, the airflows created by rotating the impeller 94 leave the air outlet 912 in different directions, resulting in noise and adversely affecting the wind pressure increasing effect.

SUMMARY OF THE INVENTION

The primary objective of the present invention is to provide a heat-dissipating fan housing that provides concentrated airflows after passing through the stationary blades to reduce the noise and to increase the wind pressure.

The heat-dissipating fan housing according to the preferred teachings of the present invention includes a casing having a compartment with two ends respectively defining an air inlet and an air outlet spaced in an axial direction. The compartment includes an impeller section, a stationary blade section, and an airflow concentration section arranged from the air inlet toward the air outlet. The stationary blade section is between the impeller section and the airflow concentration section in the axial direction. The impeller section is adapted for rotatably receiving an impeller. A mounting portion is received in the compartment. The impeller is adapted to be rotatably coupled to the mounting portion for driving airflows to enter the casing via the air inlet and to exit the casing via the air outlet. A plurality of stationary blades is interconnected between the casing and the mounting portion. The stationary blades are received in the stationary blade section. Each stationary blade includes a first edge facing the air inlet and a second edge facing the air outlet. The airflow concentration section is between the second edge of each stationary blade and the air outlet in the axial direction. The airflow concentration section concentrates the airflows after passing through the stationary blades. The noise is reduced, the wind pressure is increased, and less electricity is consumed.

Preferably, the casing has an axial length in the axial direction. The second edge of each stationary blade has a first axial spacing to the air outlet in the axial direction. The first edge of each stationary blade has a second axial spacing to the second edge of the stationary blade in the axial direction. The first axial spacing is at least 20% of the axial length. The second axial spacing is at least 10% of the axial length. The first axial spacing can be equal to the second axial spacing. Thus, the impeller section is still large enough to rotatably receive the impeller without adversely affecting the air output amount while providing the airflow concentration section for concentrating the airflows after passing through the stationary blades.

Preferably, each stationary blade includes an air incoming surface facing the air inlet. A section of the incoming surface adjacent the second edge is at an acute angle in a range between 60° and 75° with a plane perpendicular to the axial direction. Thus, the airflows created by rotating the impeller can be concentrated and not easy to diffuse after passing through the stationary blades and the airflow concentration section.

Preferably, the second edge of at least one of the stationary blades includes a guiding plate extending toward the air outlet into the airflow concentration section. The guiding plate further enhances the airflow concentration effect.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
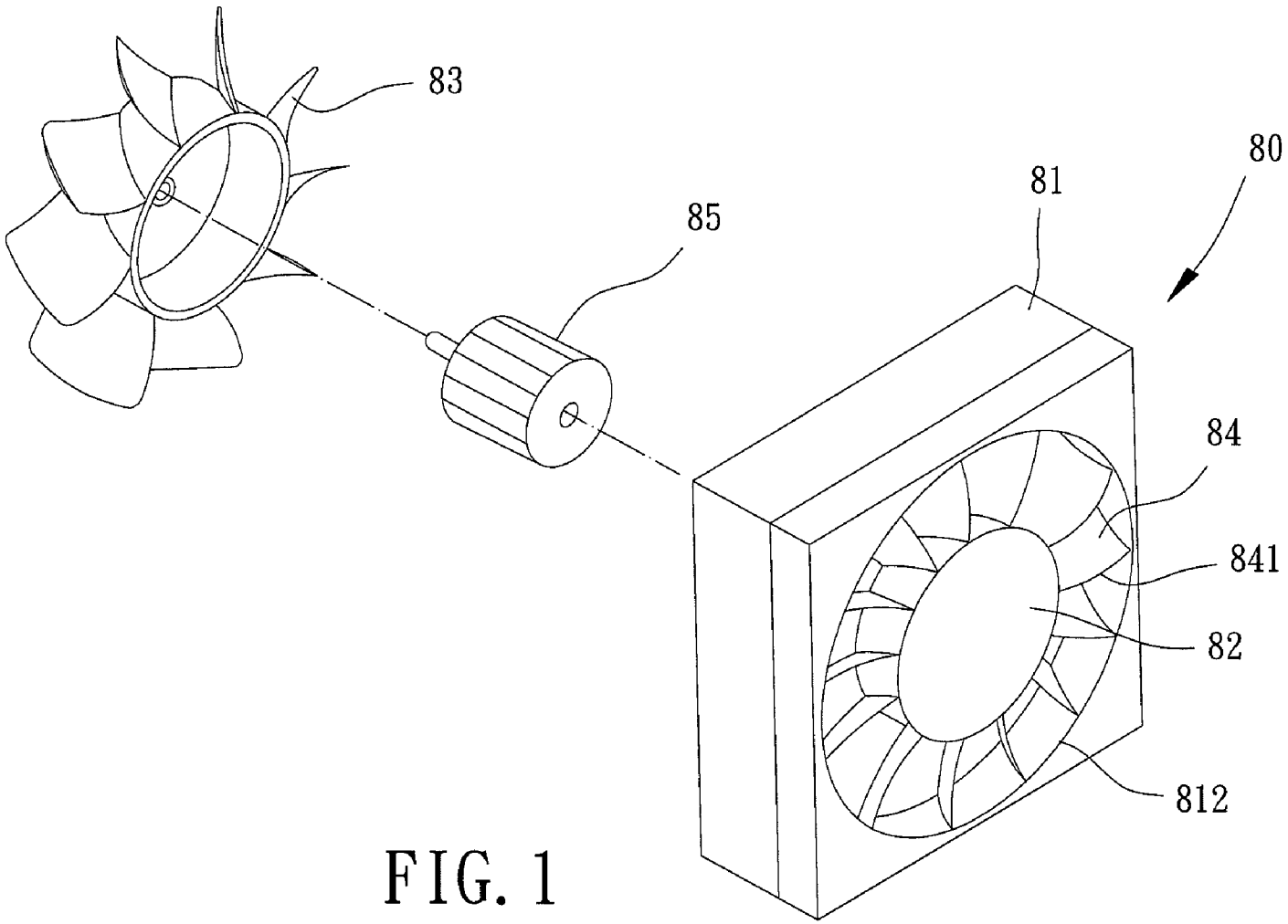
FIG. 1 PRIOR ART
FIG. 1 shows an exploded, perspective view of a conventional heat-dissipating fan housing.
Figure 2:
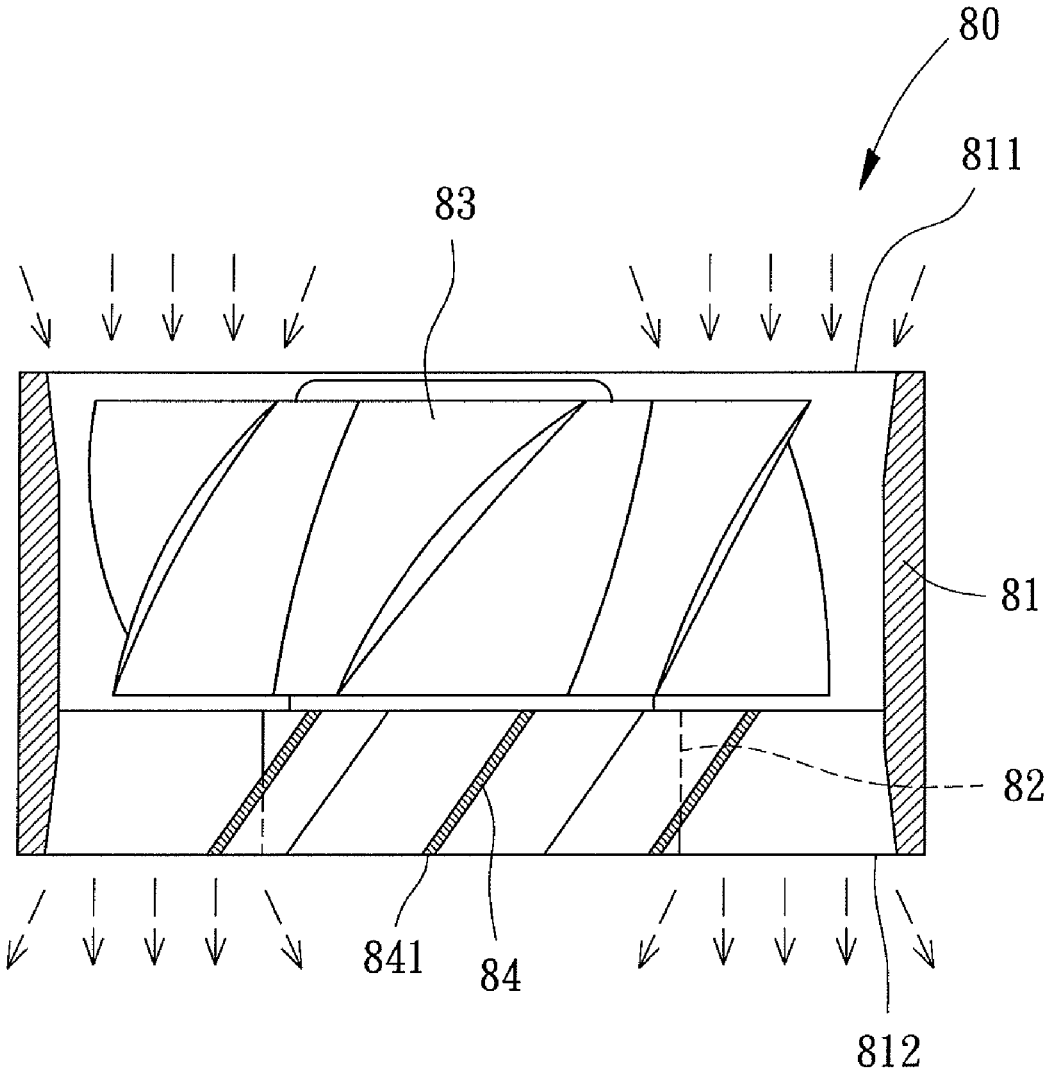
FIG. 2 PRIOR ART
FIG. 2 shows a cross sectional view of the heat-dissipating fan housing of FIG. 1 with arrow-shown airflow.
Figure 3:
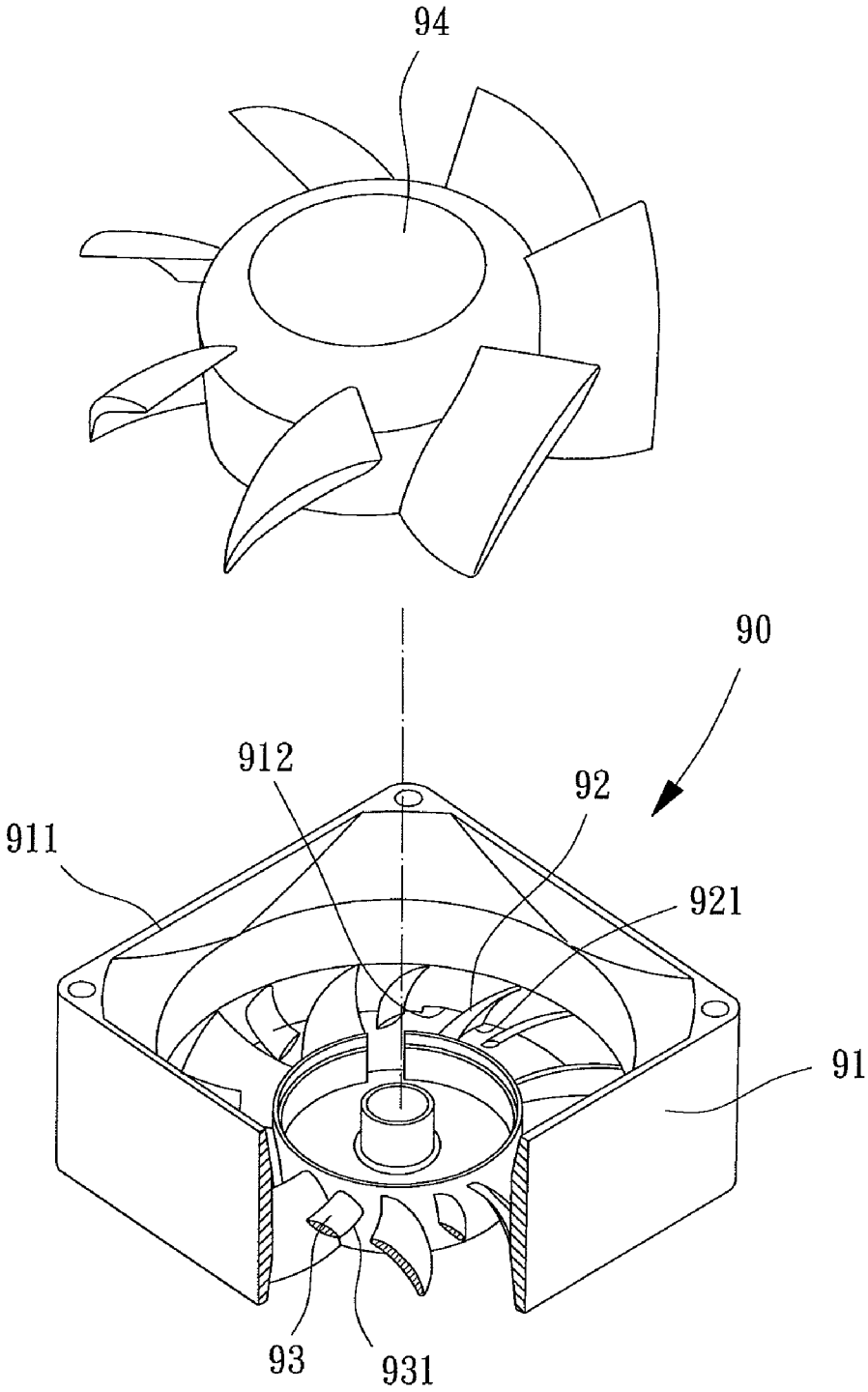
FIG. 3 PRIOR ART
FIG. 3 shows an exploded, perspective view of another conventional heat-dissipating fan housing.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "end", "portion", "section", "axial", "spacing", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 4:
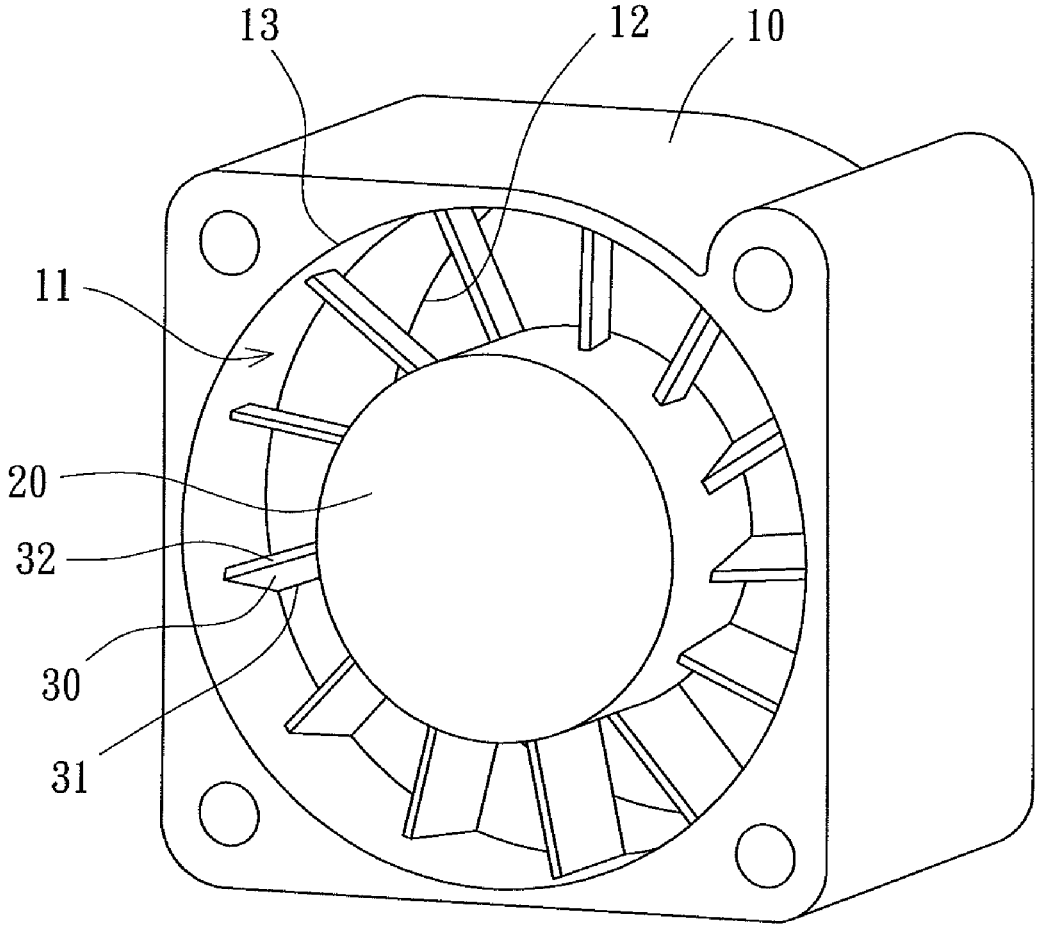
FIG. 4 shows a perspective view of a heat-dissipating fan housing of an embodiment according to the preferred teachings of the present invention.
Figure 5:
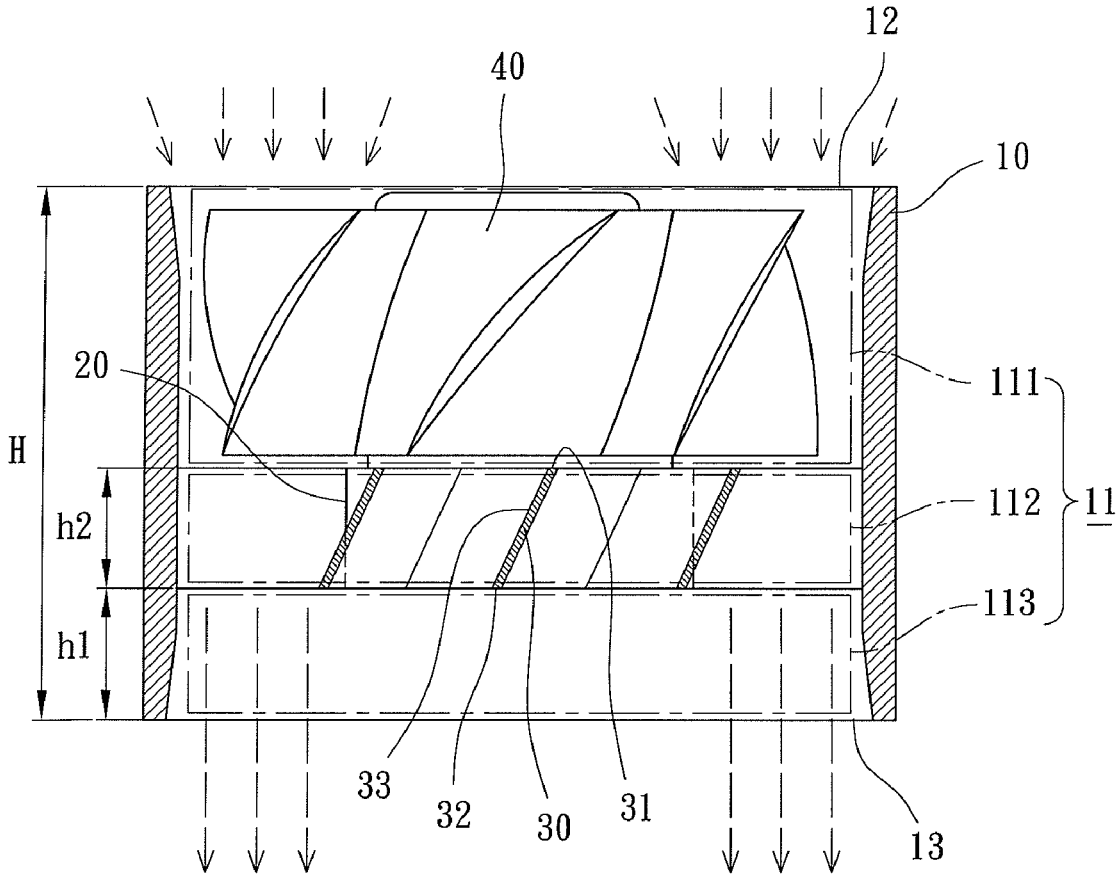
FIG. 5 shows a cross sectional view of the heat-dissipating fan housing of the embodiment in use with arrow-shown airflow.
Figure 6:
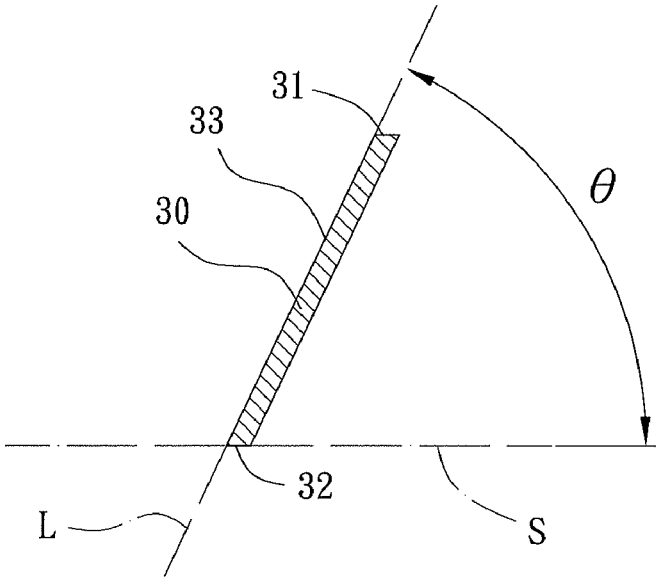
FIG. 6 shows a cross sectional view of a stationary blade of the heat-dissipating fan housing of FIG. 4.

A heat-dissipating fan housing of an embodiment according to the preferred teachings of the present invention is shown in FIGS. 4-6 of the drawings. According to the preferred form shown, the miniature fan includes a casing 10, a mounting portion 20, and a plurality of stationary blades 30.

The casing 10 includes a compartment 11 having two ends respectively defining an air inlet 12 and an air outlet 13 spaced in an axial direction. The compartment 11 includes an impeller section 111, a stationary blade section 112, and an airflow concentration section 113 arranged from the air inlet 12 toward the air outlet 13. The stationary blade section 112 is between the impeller section 111 and the airflow concentration section 113 in the axial direction.

The mounting portion 20 is received in the compartment 11 and substantially located in the stationary blade section 112. An impeller 40 and a stator forming main components of a motor are mounted to the mounting portion 20. The impeller 40 is rotatably coupled to the mounting portion 20 and rotatably received in the impeller section 111 for driving airflows to enter the casing 10 via the air inlet 12 and to exit the casing 10 via the air outlet 13 after passing through the impeller section 111, the stationary blade section 112, and the airflow concentration section 113, providing heat-dissipating function.

The stationary blades 30 are interconnected between the casing 10 and the mounting portion 20. In an example, a first end of each stationary blade 30 is coupled to an outer periphery of the mounting portion 20, and a second end of each stationary blade 30 is coupled or not coupled to an inner periphery of the casing 10. In another example, the first end of each stationary blade 30 is not coupled to the outer periphery of the mounting portion 20, and the second end of each stationary blade 30 is coupled to the inner periphery of the casing 10. The stationary blades 30 are received in the stationary blade section 112. Each stationary blade 30 includes a first edge 31 facing the air inlet 12 and a second edge 32 facing the air outlet 13. The airflow concentration section 113 is between the second edge 32 of each stationary blade 30 and the air outlet 13 in the axial direction.

The airflows flow in casing 10 is in the axial direction perpendicular to a plane S. Each stationary blade 30 includes an air incoming surface 33 facing the air inlet 12. A section of the incoming surface 33 adjacent the second edge 32 is in a plane L at an acute angle θ in a range between 60° and 75° with the plane S. Thus, the airflows created by rotating the impeller 40 can be concentrated and not easy to diffuse after passing through the stationary blades 30 and the airflow concentration section 113.

It can be appreciated that the stationary blades 30 are located in the stationary blade section 112, and the airflow concentration section 113 is between the second edge 32 of each stationary blade 30 and the air outlet 13 in the axial direction. The airflows created by rotating the impeller 40 enter the casing 10 via the air inlet 12 and pass through the stationary blades 30 into the airflow concentration section 113. The airflow concentration section 113 concentrates the airflows after passing through the stationary blades 30. Thus, the airflows exiting the casing 10 are concentrated and, therefore, not easy to diffuse. Besides, the noise is reduced, and the wind pressure is increased (FIG. 5).

In the preferred form shown in FIGS. 4-6, the casing 10 has an axial length H in the axial direction. The second edge 32 of each stationary blade 30 has a first axial spacing hi to the air outlet 13 in the axial direction. The first edge 31 of each stationary blade 30 has a second axial spacing h2 to the second edge 32 of the stationary blade 30 in the axial direction. The first axial spacing h1 is preferably at least 20% of the axial length H. The second axial spacing h2 is preferably at least 10% of the axial length H. The first axial spacing h1 can be equal to the second spacing h2 if desired. Thus, the impeller section 111 is still large enough to rotatably receive the impeller 40 without adversely affecting the air output amount while providing the airflow concentration section 113 for concentrating the airflows after passing through the stationary blades 30. Noise is suppressed, and the wind pressure is increased.

Figure 7:
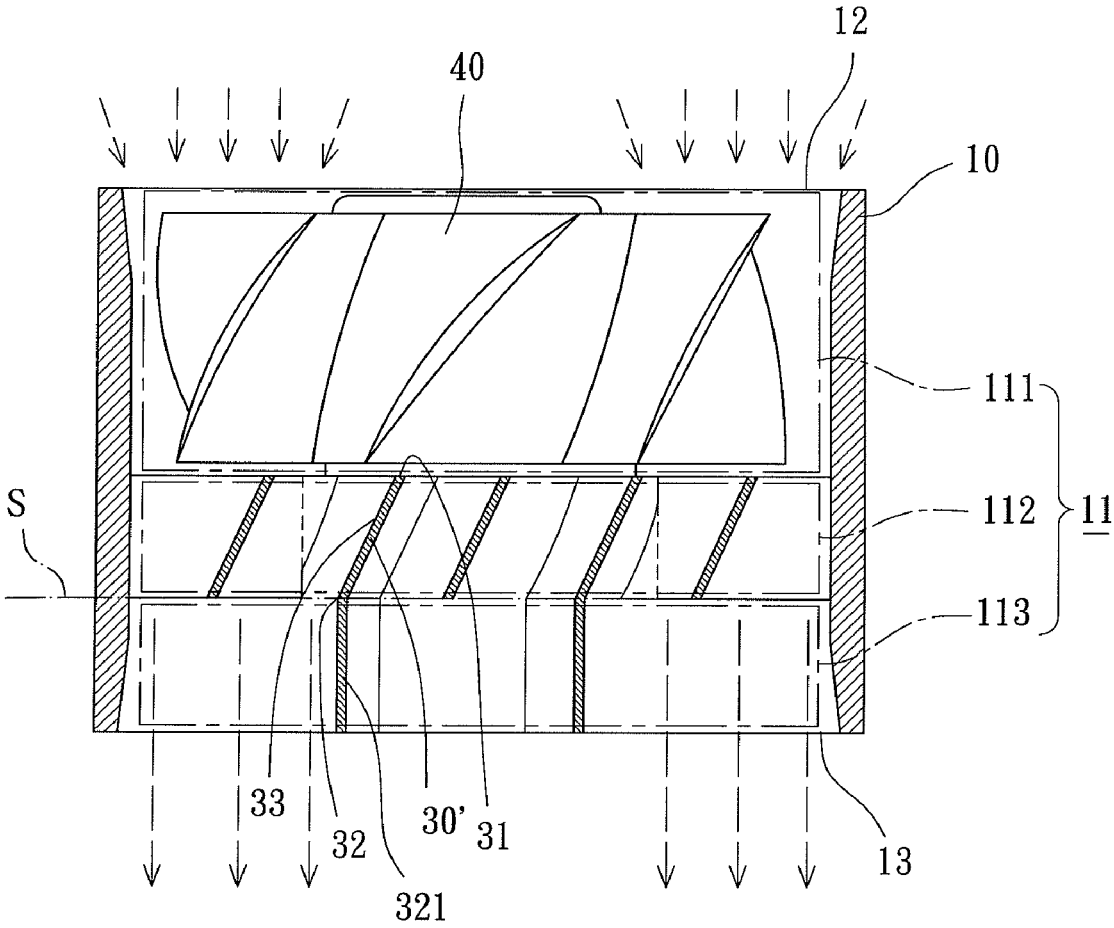
FIG. 7 shows a cross sectional view of a heat-dissipating fan housing of another embodiment according to the preferred teachings of the present invention.

FIG. 7 shows a heat-dissipating fan housing of another embodiment according to the preferred teachings of the present invention. The second edge 32 of at least one of the stationary blades 30' includes a guiding plate 321 extending toward the air outlet 13 into the airflow concentration section 113. Each guiding plate 321 is flush with the air outlet 13. However, each guiding plate 321 can be not flush with the air outlet 13. Each guiding plate 321 is preferably perpendicular to the plane S as shown. Thus, when the airflows pass through the stationary blades 30' into the airflow concentration section 113, the guiding plates 321 guide the airflow to flow in the same axial direction, preventing diffusion of the airflows leaving the air outlet 13.

The heat-dissipating fan housing according to the preferred teachings of the present invention can be utilized in fans. When compared with a conventional heat-dissipating fan housing having the same power, the heat-dissipating fan housing according to the preferred teachings of the present invention has increased wind pressure and increased air output amount by providing the airflow concentration section 113. Namely, given the same wind pressure and the same air output amount, the heat-dissipating fan housing according to the preferred teachings of the present invention consumes less electricity.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A heat-dissipating fan housing comprising:

a casing including a compartment having two ends respectively defining an air inlet and an air outlet spaced in an axial direction, with the compartment including an impeller section, a stationary blade section, and an airflow concentration section arranged from the air inlet toward the air outlet, with the stationary blade section being between the impeller section and the airflow concentration section in the axial direction, with the impeller section adapted for rotatably receiving an impeller;

a mounting portion received in the compartment, with the impeller adapted to be rotatably coupled to the mounting portion for driving airflows to enter the casing via the air inlet and to exit the casing via the air outlet; and a plurality of stationary blades interconnected between the casing and the mounting portion, with the plurality of stationary blades received in the stationary blade section, with each of the plurality of stationary blades including a first edge facing the air inlet and a second edge facing the air outlet, with the airflow concentration section being between the second edge of each of the plurality of stationary blades and the air outlet in the axial direction, and with the airflow concentration section concentrating the airflows after passing through the plurality of stationary blades.

2. The heat-dissipating fan housing as claimed in claim 1, with the casing having an axial length in the axial direction, with the second edge of each of the plurality of stationary blades having a first axial spacing to the air outlet in the axial direction, and with the first axial spacing being at least 20% of the axial length.

3. The heat-dissipating fan housing as claimed in claim 2, with the first edge of each of the plurality of stationary blades having a second axial spacing to the second edge in the axial direction, and with the second axial spacing being at least 10% of the axial length.

4. The heat-dissipating fan housing as claimed in claim 1, with the casing having an axial length in the axial direction, with the second edge of each of the plurality of stationary blades having a first axial spacing to the air outlet in the axial direction, with the first edge of each of the plurality of stationary blades having a second axial spacing to the second edge in the axial direction, and with the first axial spacing equal to the second axial spacing.

5. The heat-dissipating fan housing as claimed in claim 1, with each of the plurality of stationary blades including an air incoming surface facing the air inlet, and with a section of the air incoming surface adjacent the second edge being at an acute angle in a range between 60° and 75° with a plane perpendicular to the axial direction.

6. The heat-dissipating fan housing as claimed in claim 1, with the second edge of at least one of the plurality of the stationary blades including a guiding plate extending toward the air outlet into the airflow concentration section.

7. The heat-dissipating fan housing as claimed in claim 6, with each of the plurality of stationary blades including an air incoming surface facing the air inlet, and with a section of the air incoming surface adjacent the second edge being at an acute angle in a range between 60° and 75° with a plane perpendicular to the axial direction.

8. The heat-dissipating fan housing as claimed in claim 7, with the guiding plate being perpendicular to the plane.

* * * * *